US009383162B2

(12) United States Patent
Spykerman et al.

(10) Patent No.: US 9,383,162 B2
(45) Date of Patent: Jul. 5, 2016

(54) ADJUSTABLE FIREARM

(71) Applicants: David Joel Spykerman, Chandler, AZ (US); Jeremy Deadman, Chandler, AZ (US); Michael Przemyslaw Szczepkowski, Mesa, AZ (US)

(72) Inventors: David Joel Spykerman, Chandler, AZ (US); Jeremy Deadman, Chandler, AZ (US); Michael Przemyslaw Szczepkowski, Mesa, AZ (US)

( * ) Notice: Subject to any disclaimer, the term of this patent is extended or adjusted under 35 U.S.C. 154(b) by 0 days.

(21) Appl. No.: 14/322,829

(22) Filed: Jul. 2, 2014

(65) Prior Publication Data

US 2016/0003576 A1 Jan. 7, 2016

(51) Int. Cl.

| | |
|---|---|
| ***F41A 21/00*** | (2006.01) |
| ***F41C 23/14*** | (2006.01) |
| ***F41C 23/10*** | (2006.01) |

(52) U.S. Cl.

CPC ..... *F41C 23/14* (2013.01); *F41C 23/10* (2013.01)

(58) Field of Classification Search

USPC ..... 42/73, 71.01

See application file for complete search history.

(56) References Cited

U.S. PATENT DOCUMENTS

| | | | | |
|---|---|---|---|---|
| 5,946,842 | A * | 9/1999 | Nyzell et al. | 42/72 |
| 8,601,734 | B1 * | 12/2013 | Hopkins et al. | 42/73 |
| 9,010,008 | B2 * | 4/2015 | Hovey | 42/72 |
| 2009/0313873 | A1 * | 12/2009 | Roth | 42/72 |
| 2011/0283583 | A1 * | 11/2011 | Freed | 42/71.01 |
| 2013/0340312 | A1 * | 12/2013 | Fulton et al. | 42/73 |

* cited by examiner

*Primary Examiner* — J. Woodrow Eldred
(74) *Attorney, Agent, or Firm* — Iussa Law, PLLC

(57) ABSTRACT

An adjustable firearm generally comprises a firearm body comprising an adjustable handgrip to vary a handgrip angle with respect to a barrel of the firearm, wherein the adjustable handgrip comprises a substrate and an overlay. In an embodiment, the substrate affixes to the firearm body and the overlay couples to the substrate at one of at least multiple angles with respect to a firearm barrel. In another embodiment, a firearm body comprises an integrated substrate configured to receive an overlay, wherein the overlay couples to the substrate at one of at least multiple angles with respect to a firearm barrel. Among various representative embodiments, the substrate or overlay may comprise a fixed geometry and the substrate or overlay may comprise an adjustment mechanism to couple one to the other at various positions. The present invention may comprise a method for manufacturing, packaging, marketing, distributing, and/or selling the adjustable firearm.

7 Claims, 9 Drawing Sheets

ADJUSTABLE FIREARM

CROSS-REFERENCES TO RELATED APPLICATIONS

This application claims the benefit and filing date of U.S. Provisional Patent Application No. 61/841,997, filed 2 Jul. 2013, and incorporates the disclosure of that application by reference.

BACKGROUND OF THE INVENTION

Firearms, such as AR-15 assault rifles, handguns, and the like, may be purchased with handgrips disposed at different angles with respect to the barrel of the firearm. However, once the weapon is purchased with a handgrip at a particular angle, the handgrip angle cannot be changed without refitting the weapon with a new handgrip. While a particular handgrip angle may feel comfortable at the time of acquiring the weapon, through regular use or altering circumstances one may later discover that a different angle is preferred for increased firing accuracy and/or efficacy.

Various situations lend themselves to benefit from a firearm that has an adjustable angled handgrip. For example, from a procurement standpoint, whether it is the military or another mass firearm acquisition entity, firearms would not have to be procured and stocked with grips at various angles. Rather, the weapons could all be procured and stocked having adjustable angled handgrips. From a tactical perspective, while a handgrip at a particular angle may be most comfortable in one shooting position, another angle may be more comfortable for different shooting positions, i.e., standing, sitting, lying, etc. Further, form a cross-user perspective, a single weapon having an adjustable angle grip can accommodate multiple users. i.e., more than one person may use that particular firearm, wherein each user is able to adjust the angle of the handgrip to that which is most comfortable for him or her.

There are technologies that exist that provide a weapon's user/owner to retro-fit their weapon with a handgrip having a different angle, but most require the user to disassemble the weapon's grip and replace it with a different angle grip. Other technologies may require excessive tooling operations and/or lengthy time commitments to adjust the handgrip angle. The adjustable firearm disclosed herein seeks to overcome these disadvantages by providing an owner/user with a simplistic, easy to use, time saving system to adjust an angle of a firearm's handgrip.

SUMMARY OF THE INVENTION

Among various representative embodiments, an adjustable firearm generally comprises a firearm body comprising an adjustable handgrip to vary a handgrip angle with respect to a barrel of the firearm. Among various embodiments, the adjustable firearm may comprise the adjustable handgrip to comprise a substrate and an overlay, wherein the substrate affixes to the firearm body and the overlay couples to the substrate at one of at least multiple angles with respect to the firearm barrel. In some embodiments, the substrate may comprise a fixed geometry and the overlay may comprise an adjustment mechanism to couple to the fixed geometry at various positions so as to provide for variable angles. In other embodiments, the overlay may comprise a fixed geometry and the substrate may comprise an adjustment mechanism to couple to the fixed geometry at various positions. In still other embodiments, the substrate may comprise a fixed geometry and the overlay may comprise a fixed geometry, wherein the substrate and overlay may couple, mesh, at various angles positions. Among various embodiments, an adjustable firearm may further comprise an end cap which may lock a position of the overlay to the substrate as well as protect any internal mechanisms within a handgrip.

Among various representative embodiments, an adjustable firearm may comprise a method for manufacturing, packaging, marketing, distributing, and/or selling the adjustable firearm.

BRIEF DESCRIPTION OF THE DRAWINGS

A more complete understanding of an adjustable firearm may be derived by referring to the detailed description and claims when considered in connection with the following illustrative figures. In the following figures, like reference numbers refer to similar elements and steps throughout the figures.

Elements and/or any steps in the figs. are illustrated for simplicity and clarity and have not necessarily been rendered according to any particular sequence. For example, steps that may be performed concurrently or in different order are illustrated in the figs. to help to improve understanding of embodiments of an adjustable firearm.

DETAILED DESCRIPTION OF THE INVENTION

An adjustable firearm may be described herein by terms of various functional system elements and various method steps. Such functional elements may be realized by any number of hardware components configured to perform specified functions and achieve various results. For example, an adjustable firearm may employ various firearms and/or firearm components, e.g., firearm grips, including, substrates, overlays, casings, springs, latches, pins, guides, locks, gearings, screws, ergonomics, and the like, which may carry out a variety of functions. In addition, the present invention may be practiced in conjunction with any variety of firearms and firearm type applications, whether for sport, military application, entertainment, and/or toy purpose, and any system described is merely an exemplary application for the adjustable firearm.

Further, an adjustable firearm may employ any number of conventional techniques for manufacturing, packaging, marketing, distributing, and/or selling the adjustable firearm.

Figure 1:
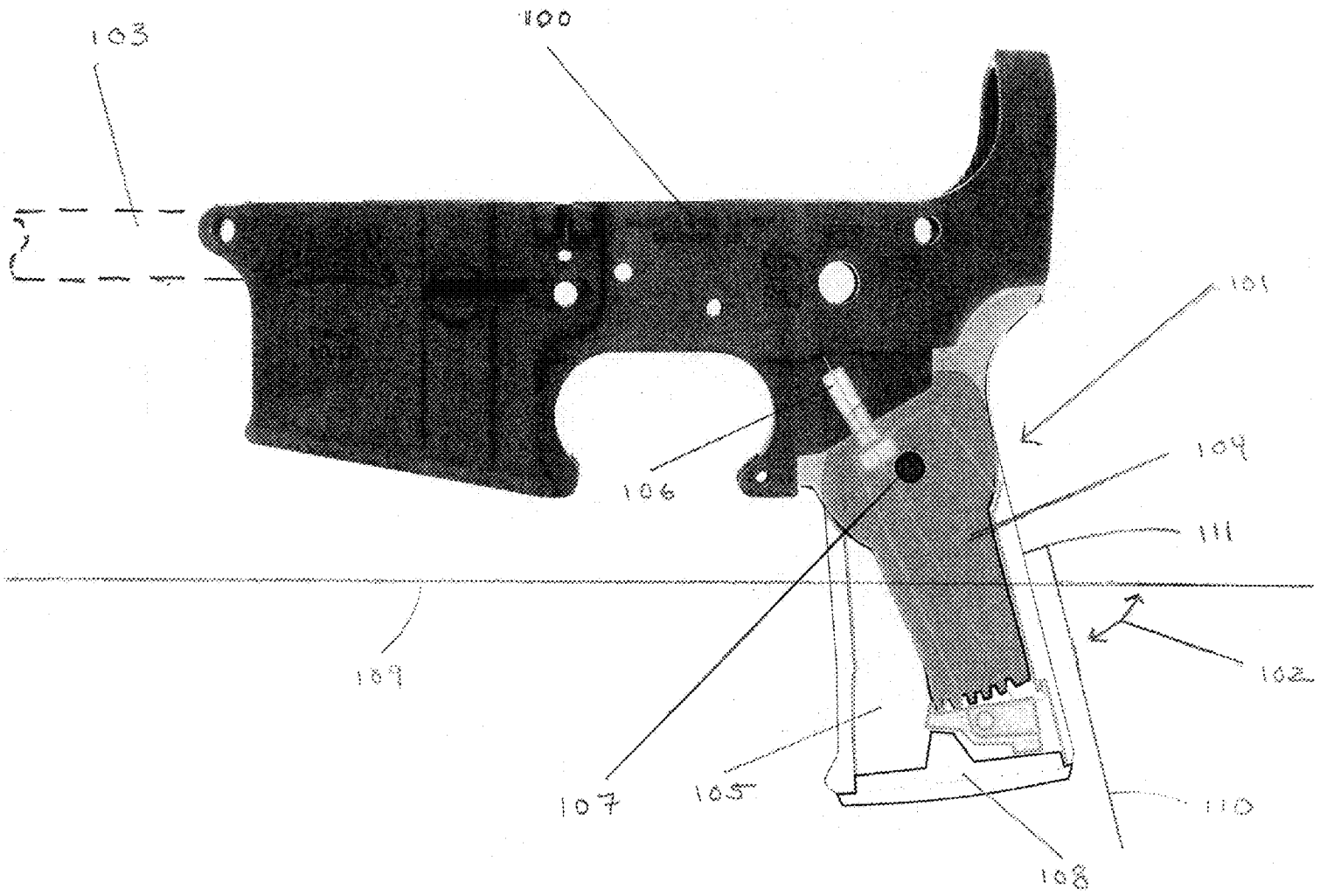
FIG. 1 representatively illustrates an exemplary embodiment of an adjustable firearm grip for a firearm body.

Various representative implementations of an adjustable firearm may be applied to any adjustable firearm. Referring now to FIG. 1, a material portion of an exemplary embodiment of an adjustable firearm is representatively illustrated, and in particular, a firearm body 100 comprising an adjustable handgrip 101 to vary a handgrip angle 102 with respect, merely for reference, to a barrel 103 of the firearm. For example, reference line 109, which is parallel to barrel 103, intersects reference line 110, which is parallel to an outer perimeter portion 111 of handgrip 101, to create angle 102. Among various exemplary embodiments, adjustable handgrip 101 may comprise a substrate, such as substrate 104 and an overlay, such as overlay 105. In an exemplary embodiment, substrate 104 may affix to firearm body 100 to secure it to firearm body 100, for example, by bolt 106; and overlay 105 may couple to substrate 104 via, for example, securing pin 107, so as to provide handgrip 101 to at one of at least multiple angles with respect to firearm barrel 103. Adjustable handgrip 101 may further comprise an end cap, such as end cap 108, to fix a position of overlay 105 to substrate 104 as well as protect any internal mechanisms within handgrip 101.

Figure 2:
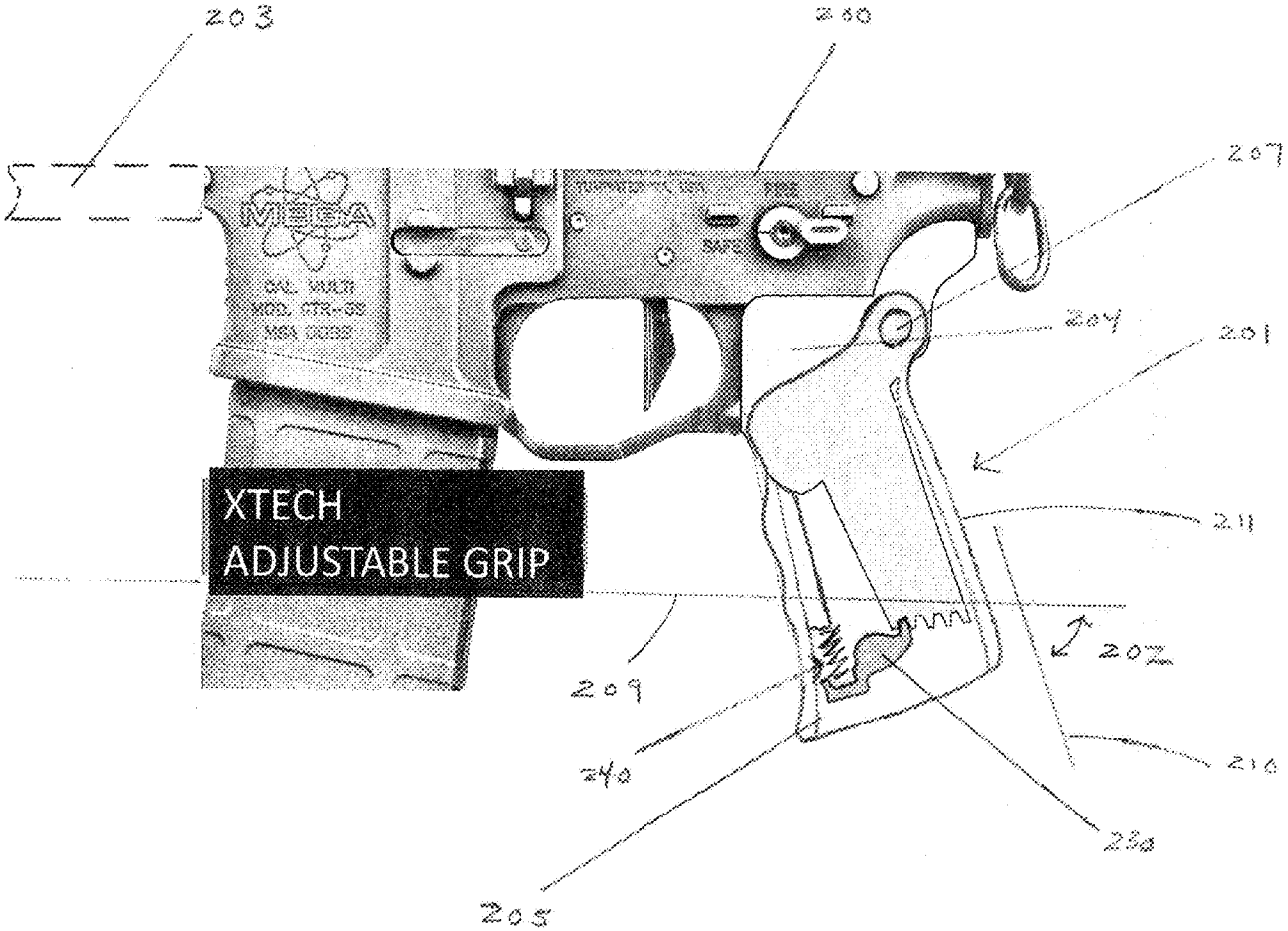
FIG. 2 representatively illustrates another exemplary embodiment of an adjustable firearm grip for a firearm body.

In accordance with other exemplary embodiments of an adjustable firearm, and now referring now to FIG. 2, a material portion of an exemplary embodiment of an adjustable firearm is representatively illustrated, and in particular, a firearm body 200 comprising an adjustable handgrip 201 to vary a handgrip angle 202 with respect, merely for reference, to a barrel 203 of the firearm. For example, reference line 209, which is parallel to barrel 203, intersects reference line 210, which is parallel to an outer perimeter portion 211 of handgrip 201, to create angle 102. Among various exemplary embodiments, adjustable handgrip 201 may comprise an integrated substrate, such as integrated substrate 204 and an overlay, such as overlay 205. In this exemplary embodiment, integrated substrate 204 rather than affix to firearm body 200, such as substrate 104 shown in FIG. 1 affixed to firearm body 100 by bolt 106; integrated substrate 204 may be part of a whole manufactured firearm body 200. In this embodiment, overlay 205 may couple to integrated substrate 204 via, for example, securing pin 207, so as to provide handgrip 201 to at one of at least multiple angles with respect to firearm barrel 203. Adjustable handgrip 201 may further comprise an end cap, not shown, similar to end cap 108 of FIG. 1, to fix a position of overlay 205 to substrate 204 as well as protect any internal mechanisms within handgrip 201.

In accordance with various exemplary embodiments, those skilled in the art will understand that an adjustable firearm grip may be implemented among various firearms such that a user may benefit from an adjustable firearm grip. As depicted in FIGS. 1 and 2, a firearm body for an assault rifle type weapon is shown, but any other weapon may benefit as well, including handguns, shotguns, military weapons, recreational weapons, sport weapons, toys, and the like. Moreover, the adjustable firearm grip is depicted throughout this disclosure of comprising of various substrates and overlays, but those skilled in the art will understand that such elements may be supplemented by additional substrates and/or overlays, as well as any other supplement elements, whether now known or developed in the future, to promote the configuration and/or operation of the adjustable firearm grip.

Figure 3:
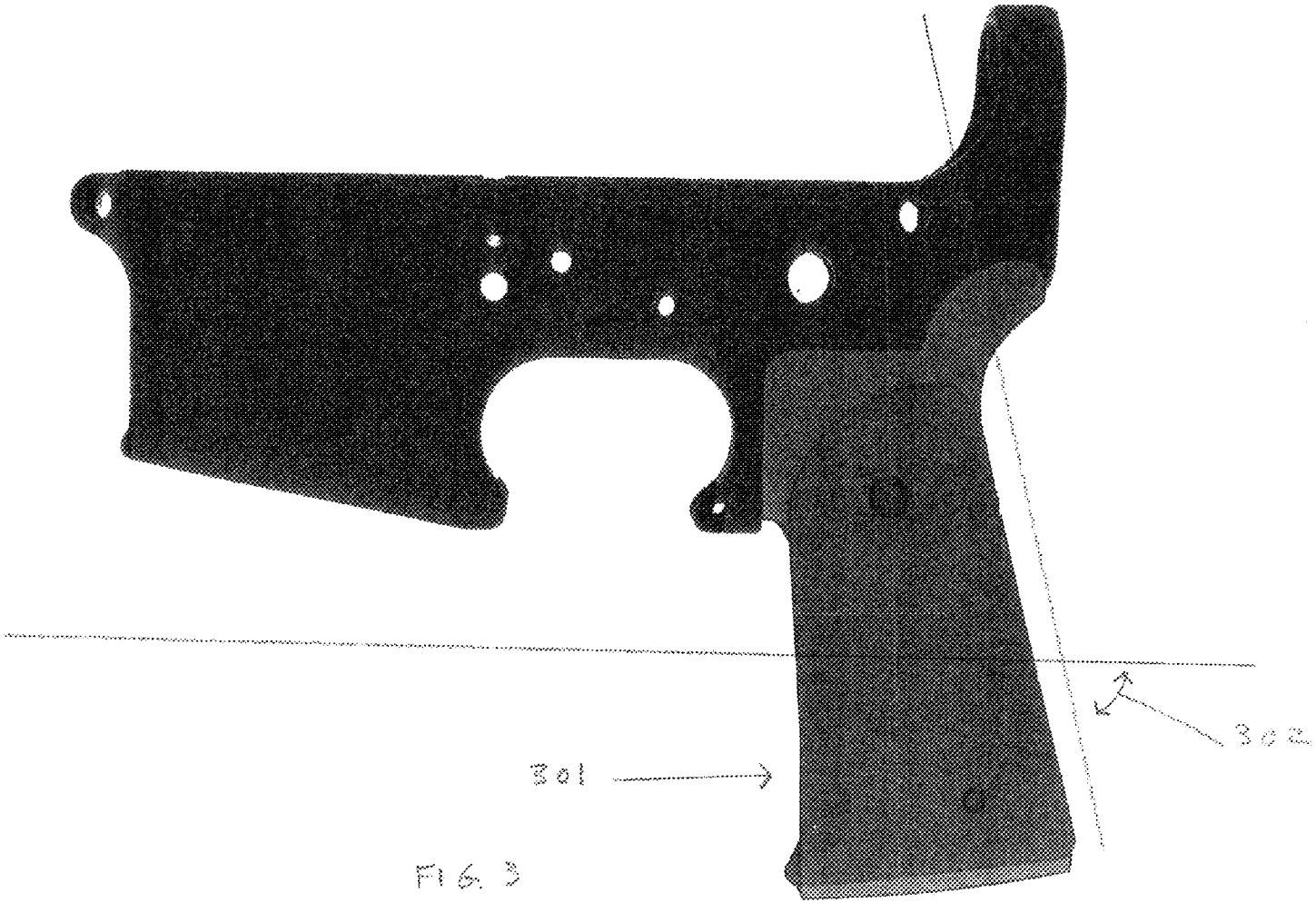
FIG. 3 representatively illustrates an exemplary embodiment of an adjustable firearm grip depicting an adjusted angle of the firearm grip.
Figure 4:
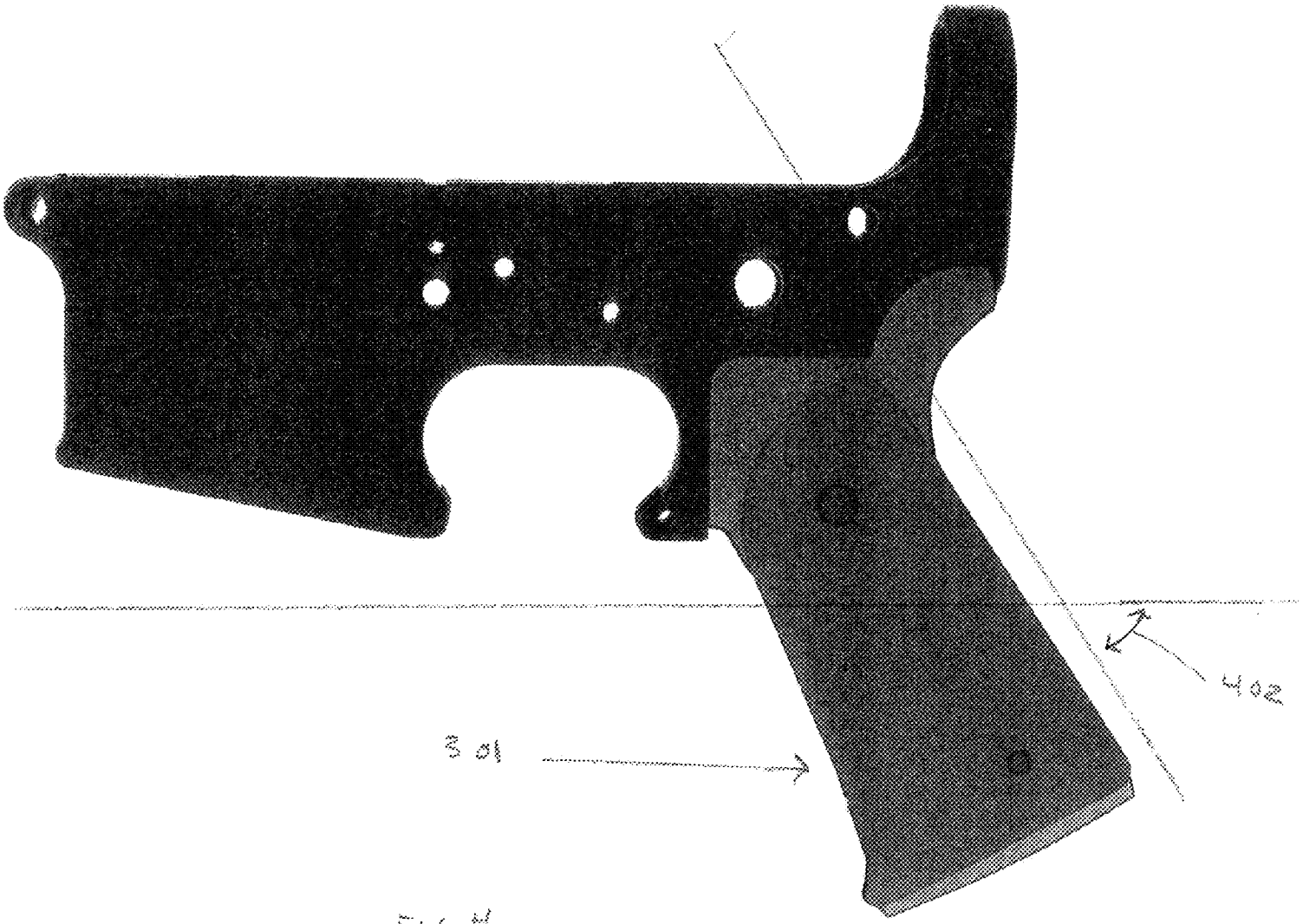
FIG. 4 representatively illustrates the exemplary embodiment of the adjustable firearm grip depicting a different adjusted angle of the firearm grip.

In accordance with various exemplary embodiments and with reference to FIGS. 3 and 4, FIG. 3 depicts an adjustable firearm handgrip 301 of an AR type weapon, and such adjustable handgrip 301 is shown at a first angled position 302, whereas FIG. 4 depicts adjustable handgrip 301 at a second angled position 402. As can be seen by comparing the figs., angle 302 is more obtuse than angle 402, thereby demonstrating how the firearm's handgrip encompasses variable handgrip angles to accommodate a user. It will be understood by those skilled in the art that adjustable firearm grip 301 may comprise virtually any angle. While the various exemplary embodiments disclosed herein, depict an angle of the firearm grip to be adjusted at various discrete angles, it will be understood by those skilled in the art that the firearm grip may take advantage of the present invention to be adjusted at any angle, discrete or otherwise.

Figure 5:
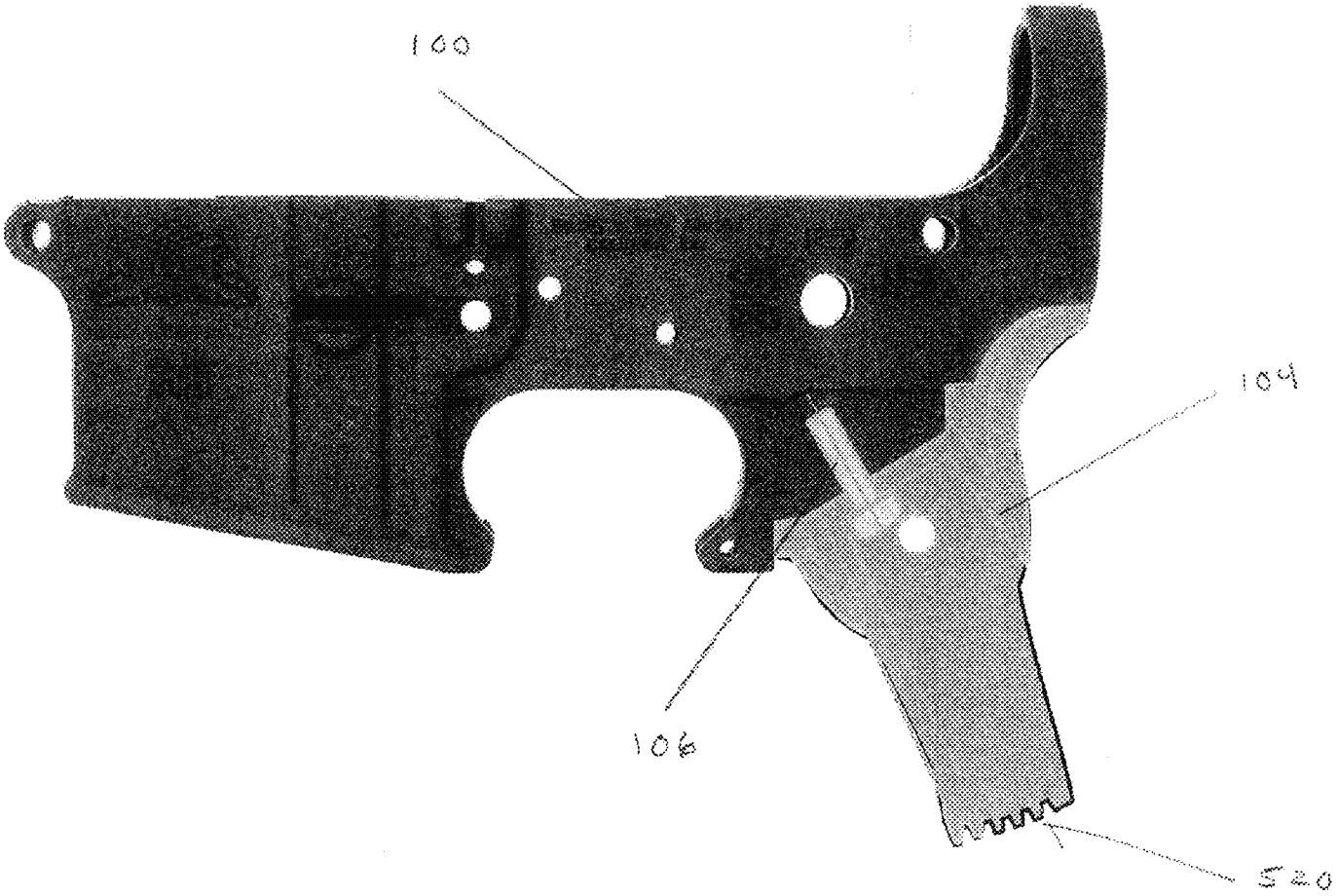
FIG. 5 representatively illustrates an exemplary embodiment of an adjustable firearm grip depicting a substrate coupled to the firearm body.

Among various exemplary embodiments, and with reference to FIG. 5, firearm body 100 may be configured to receive substrate 104. As mentioned previously, substrate 104 may be configured to couple to firearm body 100 and secured by bolt 106, however, substrate 104 may not comprise a separate piece to couple to firearm body 100, but rather may be an integrated substrate portion of firearm body 100, i.e., firearm body 100 may be formed (manufactured) to comprise substrate 104 as part of firearm body 100. Among various exemplary embodiments, substrate 104 may comprise a fixed geometry, that is, substrate 104 comprises elements such that when an overlay, such as overlay 105 or 205 comprising an adjustment mechanism, is coupled to substrate 104, the combination allows for the handgrip, such as handgrip 101 or 201, to be adjusted at various angles. For example, substrate 104 may comprise the fixed geometry, such as notches 520 that allow an adjustment mechanism of an overlay to engage notches 520, thereby facilitating the angled variability of a handgrip.

Figure 6:
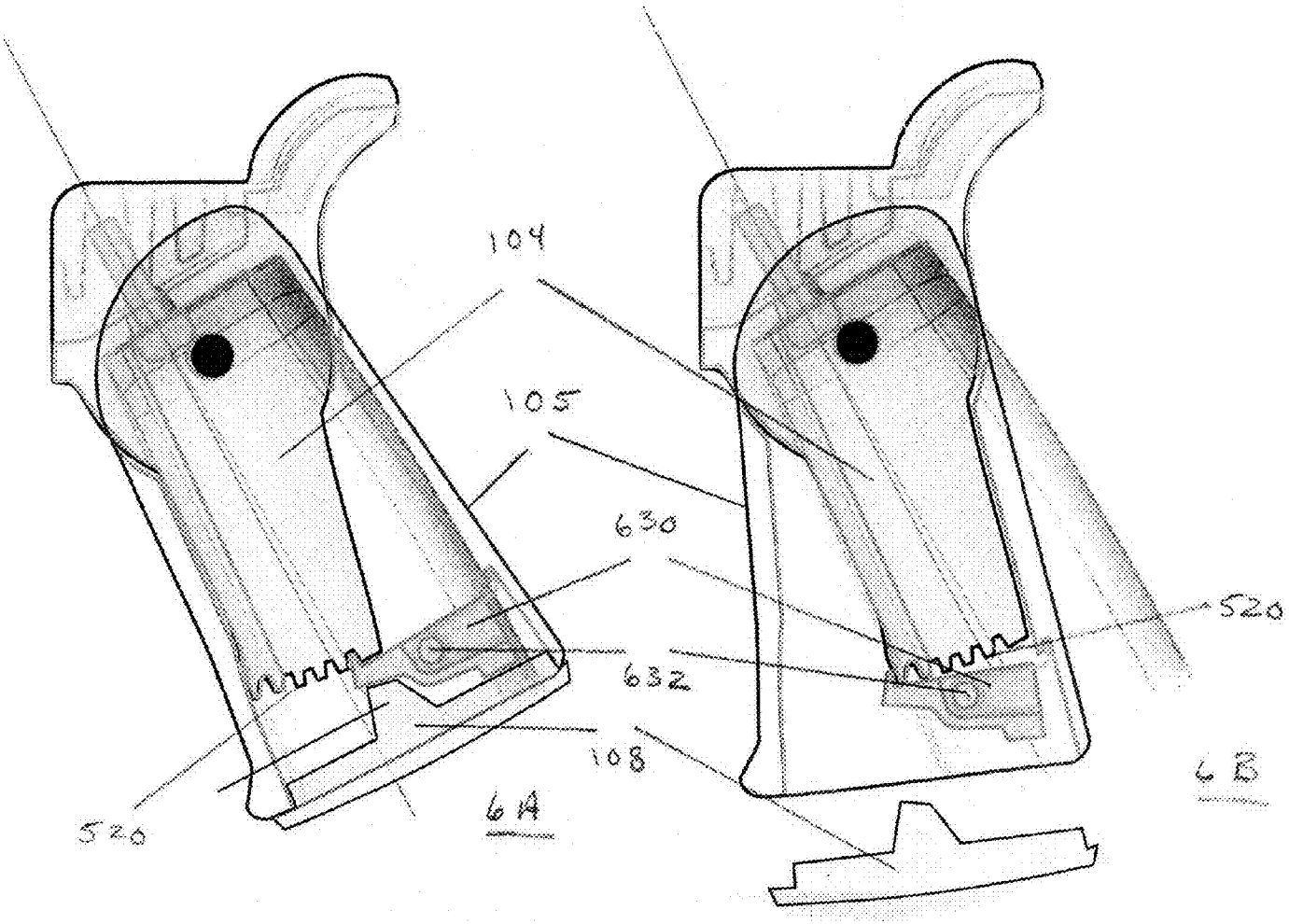
FIG. 6 representatively illustrates the exemplary embodiment of the adjustable firearm grip depicting an overlay coupled to the substrate.

Turning now to FIGS. 6A and 6B, among various exemplary embodiments, an overlay, such as overlay 105, may be suitably coupled to a substrate, such as substrate 104. In this embodiment, overlay 105 comprises adjustment mechanism 630 that may be actuated about an axis, such as axis 632, to facilitate an engagement or disengagement of adjustment mechanism 630 with notches 520. As can be seen in this exemplary embodiment, adjustment mechanism 630 engages one of the multiple fixed geometric notches 520, thereby causing the angle of the hand grip to be altered. Furthermore, in this exemplary embodiment, end cap 108 may be coupled to overlay 105, whereby the geometry of end cap 108 may be configured, such that when coupled to overlay 105 a portion of end cap 108 engages adjustment mechanism 630 to secure its engagement with notches 520. End cap 108 may further operate to enclose internal components, such as notches 520, adjustment mechanism 630, etc. It will be understood by those skilled in the art, that the exemplary embodiment discussed and illustrated is merely one exemplary embodiment, and other exemplary embodiments to adjust the angle of a firearm handgrip may be employed. For example, returning to FIG. 2, instead of an adjustment mechanism of an overlay engaged to fixed geometric notches of a substrate and secured by an end cap, an overlay may comprise alternate mechanisms, for example, a spring leveraging element, such as shown by spring leveraging element 240, which may provide force to an adjustment mechanism 230, thereby locking firearm grip 201 in a selected angled position. In this exemplary embodiment, an end cap, similar to end cap 108 of FIG. 1, is not needed to secure an adjustment mechanism of an overlay to a fixed geometry of a substrate, however one may be incorporated to protect any internal components.

Figure 7:
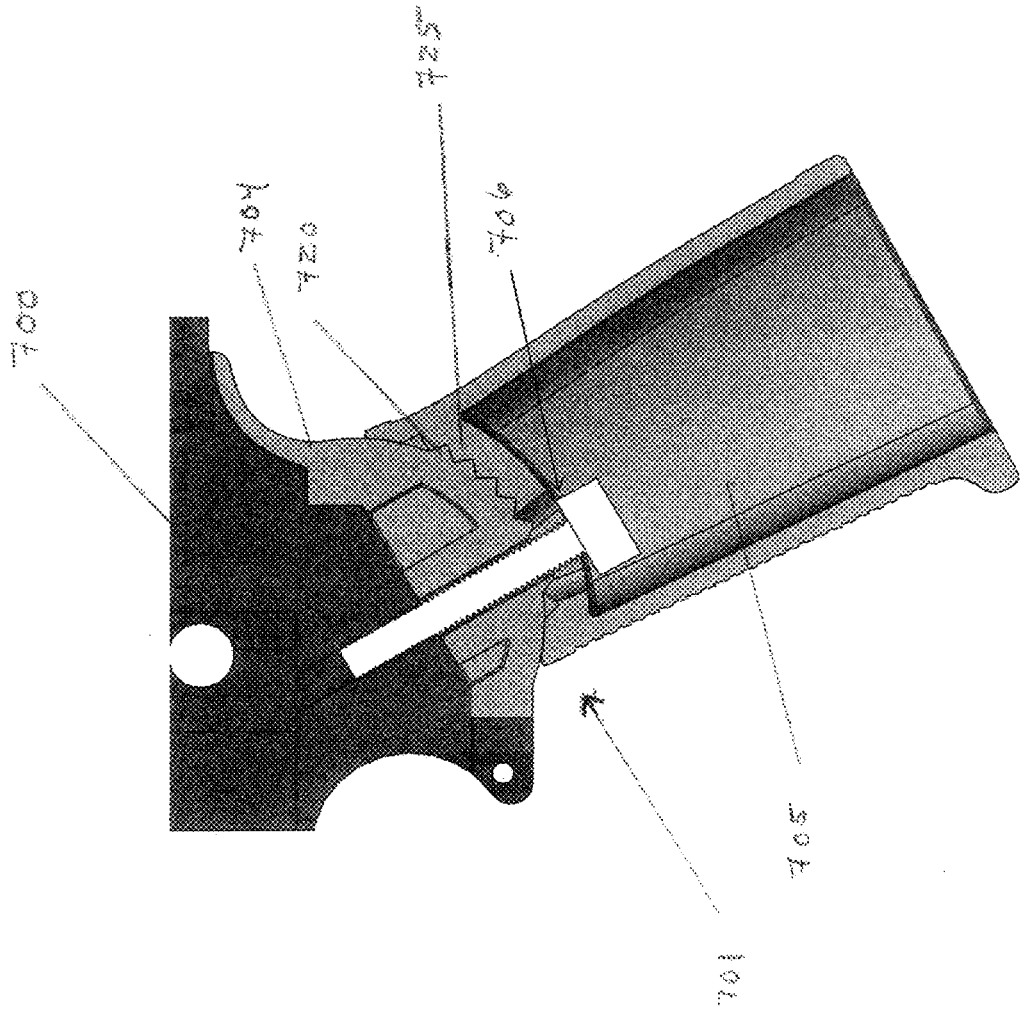
FIG. 7 representatively illustrates an exemplary embodiment of an adjustable firearm grip depicting an overlay and a substrate comprising fixed geometries.

It will be understood by those skilled in the art that in alternate embodiments, rather than a substrate comprising fixed geometries and an overlay comprising adjustment mechanisms, a substrate may comprise adjustment mechanisms and an overlay may comprise a fixed geometry. And in still other embodiments both of a substrate and an overlay may comprise adjustment mechanisms that interact to allow for a variability of a firearm's handgrip angle, and still yet other embodiments may comprise both a substrate and an overlay to comprise fixed geometries that interact to provide for a variability of a firearm's handgrip. For example, and with reference to FIG. 7, an exemplary embodiment is depicted wherein both a substrate and an overlay comprise fixed geometries that interact, i.e. mesh, to provide for a variability of a firearm's handgrip angle. In this example, a firearm body 700 may couple to a substrate 704 comprising a saw-toothed pattern of notches 720. Similarly, an overlay 705 may comprise a mating saw-toothed pattern of notches 725. As can be seen, notches 720 and 725 may interlock at various positions so as to provide for a variability of position for handgrip 701. In this embodiment, substrate 704 and overlay 705 may be secured at their interlocked position by a securing bolt 706. However, other embodiments, instead of being secured together and on-through to the firearm body, other securing mechanisms may be employed, for example, pins, welds, latches, levers, springs, snaps, now known or developed in the future. Moreover, substrate 704 and/or overlay 705 may benefit from any other type of geometric configuration other than a meshed saw-toothed configuration to fix an angled position. For example, substrate 704 and overlay 705 may interconnect by any other geometric inter-locking shapes, such as gears, cogs, pins, wheels, flanges, and the like, and in some embodiments, interlocking geometric configurations may not be relied upon at all, but rather substrate 704 and overlay 705 may benefit from a mated friction force between them to fix an angled position. In such a friction embodiment, a user can adjust an angle of an adjustable handgrip in a non-discrete manner.

Figure 8:
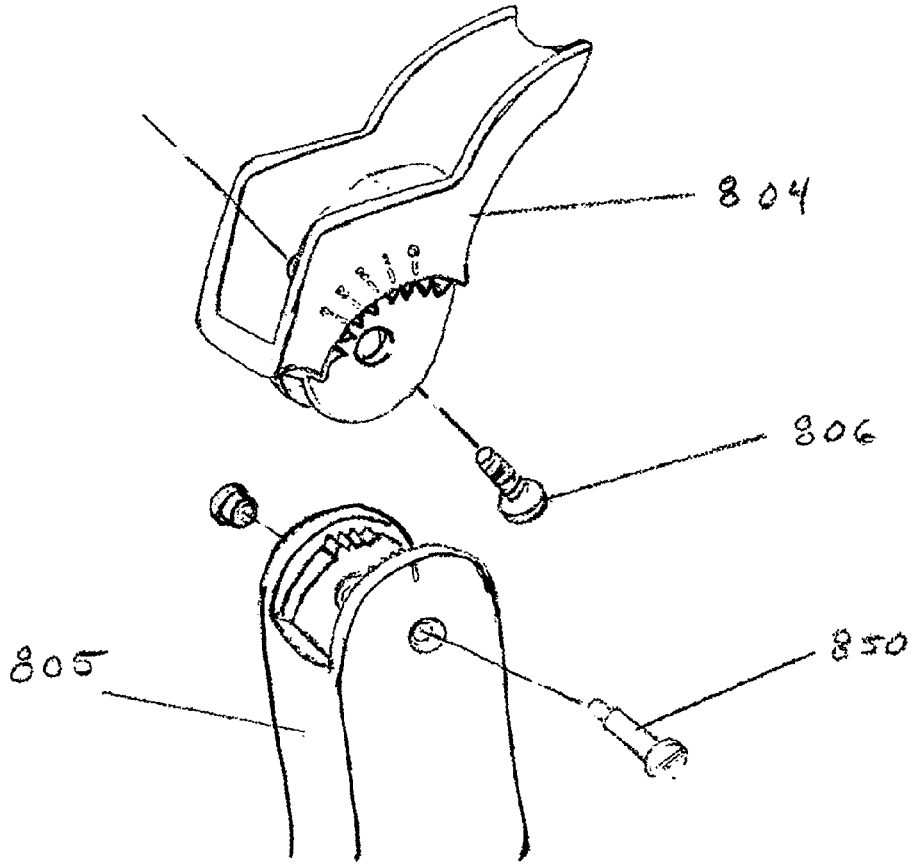
FIG. 8 representatively illustrates an exemplary embodiment of an adjustable firearm grip depicting another overlay and substrate comprising fixed geometries.

In another exemplary embodiment wherein a substrate and an overlay comprise fixed geometries, FIG. 8 depicts an embodiment wherein substrate 804 having a fixed geometry comparably may be accepted by a fixed geometry of an overlay 805. Here, substrate 804 and overlay 805 may be affixed to a firearm body (not shown) by a securing bolt 806. However, in this embodiment, rather than having to control an adjustment by a securing bolt, as depicted by securing bolt 706 of FIG. 7, an adjustment screw 850 may be manipulated to allow substrate 804 and overlay 805 to be repositioned, thereby causing a variability of a position for a firearm's handgrip. It will be understood by those skilled in the art that other mechanisms other than screw 850 may be used to allow substrate 804 and 805 to manipulate with respect to one another. For example, a push button mechanism may be employed to provide for a tool-less operation, or a pin, bolt, thumb latch, and the like may be used. Moreover, such mechanisms may not be limited to merely this exemplary embodiment, but rather may be employed by other exemplary embodiments discussed herein.

Figure 9:
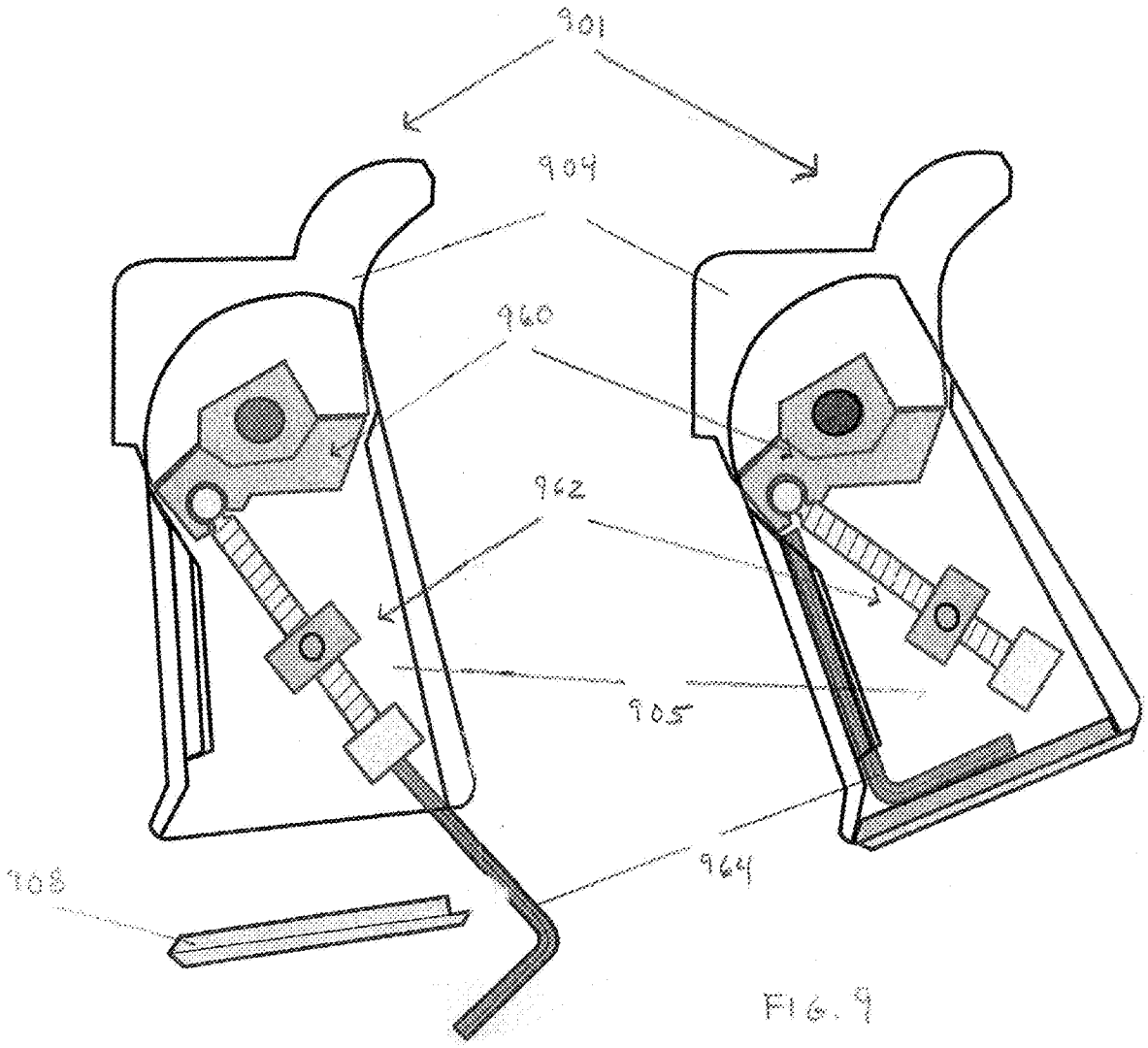
FIG. 9 representatively illustrates an exemplary embodiment of an adjustable firearm grip depicting a substrate and an overlay both comprising adjustment mechanisms.

As mentioned previously, an exemplary embodiment of the present invention may comprise a configuration wherein both a substrate and an overlay may comprise adjustment mechanisms to provide for a variability of a handgrip position. Turning to FIG. 9, an exemplary embodiment depicts substrate 904 comprising adjustment mechanism 960 that interacts with adjustment mechanism 962 of overlay 905. In this embodiment a key, such as allen wrench 964, may be used to actuate adjustment mechanism 962 thereby causing handgrip 901 to have its position altered. Furthermore, this exemplary embodiment demonstrates how any tooling that may be used can be housed within handgrip 901 for safe-keeping and quick access. Handgrip 901, similar to handgrip 101 of FIG. 101, may comprise an end cap 908 to secure the internal mechanisms, and in this case, allen wrench 964 as well.

In accordance with various exemplary embodiments, a user of an adjustable firearm may alter an angle of the firearm's grip so as to accommodate the preferences of the user. For example, a user owning a firearm may use appropriate tooling to remove the existing firearm's grip and replace it with an adjustable firearm grip consistent with the various exemplary embodiments disclosed and claimed by the present invention. For example, and referencing the exemplary embodiment depicted by FIG. 1, a user, having already removed a fixed firearm grip, may secure a substrate, such as substrate 104, to a firearm body, such as firearm body 100, by securing bolt, such as securing bolt 106. The user may then affix overlay, such as overlay 105, to the substrate and couple them together using a securing pin, such as securing pin 107. The user may then alter the angle of the handgrip by actuating the mechanism of the overlay such that it engages one of the fixed geometric portions (notches) of the substrate. To secure the desired angle, the user can then affix an end cap, such as end cap 108, to the butt end of the handgrip, wherein the end cap is configured to engage the overlay's mechanism and lock it into position. Those skilled in the art will understand that this is merely one exemplary use of and adjustable firearm grip, and other uses consistent with the exemplary embodiments disclosed herein, fall within the ambit of the present invention.

In accordance with various exemplary embodiments of an adjustable firearm, a method for manufacturing an adjustable firearm may comprise, providing a firearm body, such as firearm body 100, 200, 700, and the like, comprising an adjustable handgrip, such as adjustable handgrip 101, 201, 301, 701, 901 and the like, to vary a handgrip angle, such as handgrip angle, 102, 202, 302, 402, and the like, with respect to a barrel of the firearm, such as barrel, 103, 203, and the like. Among various exemplary embodiments, the adjustable handgrip may comprise, a substrate, such as substrate 104, 204, 704, 804, 904 and the like; and an overlay, such as overlay 105, 205, 705, 805, 905 and the like. Among various exemplary embodiments, the substrate may be affixed to the firearm body and the overlay may be coupled to the substrate at one of at least multiple angles with respect to the firearm barrel, wherein the substrate comprises a fixed geometry and the overlay comprises an adjustment mechanism to couple to the fixed geometry at the various angle positions. In some exemplary embodiments, the overlay comprises a fixed geometry and the substrate comprises an adjustment mechanism to couple to the fixed geometry at various angled positions. In other exemplary embodiments, the substrate comprises a fixed geometry and the overlay comprises a fixed geometry, wherein the substrate and overlay couple at various angles positions. And still yet in other exemplary embodiments, both the overlay and the substrate comprise adjustment mechanisms that interact together to provide for various angled positions of a firearm's handgrip. Among various exemplary embodiments, the adjustable handgrip may comprise an end cap, such as end cap 108, 908 and the like, to fix a position of the overlay to the substrate and/or to enclose the end of the handgrip to secure any internal mechanisms or tooling items. Those skilled in the art will understand that the present invention may also comprise a method for manufacturing, packaging, marketing, distributing, and/or selling the adjustable firearm.

In the foregoing specification, the adjustable firearm has been described with reference to specific exemplary embodiments. Various modifications and changes may be made, however, without departing from the scope of the adjustable firearm as set forth in the claims. The specification and figures are illustrative, rather than restrictive, and modifications are intended to be included within the scope of the adjustable firearm. Accordingly, the scope of the adjustable firearm should be determined by the claims and their legal equivalents rather than by merely the examples described.

For example, the steps recited in any method or process claims may be executed in any order and are not limited to the specific order presented in the claims. Additionally, the components and/or elements recited in any system claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes" "is" or any variation thereof, are intended to reference a non-exclusive inclusion, such that a process, method, article, composition, system, or apparatus that comprises a list of elements does not include only those elements recited, but may also include other elements not expressly listed or inherent to such process, method, article, composition, system, or apparatus. Other combinations and/or modifications of the above-described structures, arrangements, applications, proportions, elements, materials or components used in the practice of an adjustable firearm, in addition to those not specifically recited, may be varied or otherwise particularly adapted to specific environments, manufacturing specifications, design parameters or other operating requirements without departing from the general principles of the same.

We claim:

1. An adjustable firearm comprising:

a firearm body comprising a detachable, adjustable handgrip that facilitates varying a handgrip angle with respect to a barrel of the firearm, wherein the handgrip comprises a substrate coupled to an overlay wherein, the substrate comprises; a receiver portion to couple to a lower portion of a receiver of the firearm body, a substrate through hole to receive a securing bolt, and a substrate saw-toothed portion to mesh with an overlay saw-toothed portion, and wherein;

the overlay comprises an overlay through hole to receive the securing bolt, and wherein the securing bolt secures the mesh between the substrate saw-toothed portion and the overlay saw-toothed portion to the lower portion of the receiver of the firearm body, and wherein;

the substrate saw-toothed portion meshed with the overlay saw-toothed portion facilitates adjusting the handgrip angle with respect to the barrel of the firearm.

2. The adjustable firearm of claim 1, wherein the overlay couples to the substrate at one of at least multiple angles with respect to the firearm barrel.

3. The adjustable firearm of claim 2, further comprising an end cap to secure an open bottom end of the substrate.

4. A method to provide an adjustable firearm comprising:

providing a firearm body comprising a detachable, adjustable handgrip that facilitates varying a handgrip angle with respect to a barrel of the firearm, wherein the handgrip comprises a substrate coupled to an overlay;

providing the substrate to comprise; a receiver portion to couple to a lower portion of a receiver of the firearm body, a substrate through hole to receive a securing bolt, and a substrate saw-toothed portion to mesh with an overlay saw-toothed portion, and wherein;

providing the overlay to comprise an overlay through hole to receive the securing bolt, and wherein the securing bolt secures the mesh between the substrate saw-toothed portion and the overlay saw-toothed portion to the lower portion of the receiver of the firearm body; and wherein;

the substrate saw-toothed portion meshed with the overlay saw-toothed portion facilitates adjusting the handgrip angle with respect to the barrel of the firearm.

5. The method of claim 4, wherein the overlay couples to the substrate at one of at least multiple angles with respect to the firearm barrel.

6. The method of claim 4, further comprising an end cap to secure an open bottom end of the substrate.

7. An adjustable firearm grip comprising:

a substrate coupled to an overlay wherein, the substrate comprises; a receiver portion to couple to a lower portion of a receiver of a firearm body, a substrate through hole to receive a securing bolt, and a substrate saw-toothed portion to mesh with an overlay saw-toothed portion, and wherein;

the overlay comprises an overlay through hole to receive the securing bolt, and wherein the securing bolt secures the mesh between the substrate saw-toothed portion and the overlay saw-toothed portion to the lower portion of the receiver of the firearm body, and wherein;

the substrate saw-toothed portion meshed with the overlay saw-toothed portion facilitates adjusting the handgrip angle with respect to the barrel of the firearm.

* * * * *